US010654057B2

(12) United States Patent
Jacquemart et al.

(10) Patent No.: US 10,654,057 B2
(45) Date of Patent: May 19, 2020

(54) FLUID-PRODUCT DISPENSER

(71) Applicant: APTAR FRANCE SAS, Le Neubourg (FR)

(72) Inventors: Regis Jacquemart, Ecardenville sur Eure (FR); Alexandre Chen, Le Neubourg (FR); Arnaud Leboucher, Le Neubourg (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/528,588

(22) PCT Filed: Dec. 17, 2015

(86) PCT No.: PCT/FR2015/053591
§ 371 (c)(1),
(2) Date: May 22, 2017

(87) PCT Pub. No.: WO2016/097629
PCT Pub. Date: Jun. 23, 2016

(65) Prior Publication Data

US 2017/0304854 A1 Oct. 26, 2017

(30) Foreign Application Priority Data

Dec. 19, 2014 (FR) ..... 14 62965

(51) Int. Cl.
*B05B 9/08* (2006.01)
*B05B 12/00* (2018.01)
*B05B 11/00* (2006.01)

(52) U.S. Cl.
CPC ..... *B05B 9/0811* (2013.01); *B05B 12/002* (2013.01); *B05B 11/3053* (2013.01)

(58) Field of Classification Search
CPC ... B05B 7/2418; B05B 7/2416; B05B 12/002; B05B 15/30; B05B 9/0811
See application file for complete search history.

(56) References Cited

U.S. PATENT DOCUMENTS 1,899,749 A * 2/1933 Deutsch ..... B05B 7/12 239/143
2,547,094 A * 4/1951 Rich ..... B05B 7/2405 239/351

(Continued)

FOREIGN PATENT DOCUMENTS

EP 1 513 616 A1 3/2005
WO 2005/016550 A1 2/2005

OTHER PUBLICATIONS

International Search Report for PCT/FR2015/053591 dated Apr. 4, 2016 [PCT/ISA/210].

(Continued)

*Primary Examiner* — Frederick C Nicolas
*Assistant Examiner* — Bob Zadeh
(74) *Attorney, Agent, or Firm* — Sughrue Mion, PLLC

(57) ABSTRACT

A fluid dispenser having a reservoir (1), a dispenser head (T) provided with a dispenser orifice (62), a dip tube (22), a pusher (6) axially movable over a determined stroke, an electric pump (4) that delivers air into the reservoir (1) so as to force the fluid through the dip tube (22) and actuated by the pusher (6), and a fluid outlet valve (7). All of the air coming from the electric pump is delivered into the reservoir. The electric pump (4) is activated by the pusher (6) as soon as it leaves its high rest position, and the outlet valve (7) is opened only in the proximity of the low depressed position, such that the electric pump (4) is electrically powered before the outlet valve (7) is opened and delivers air into the reservoir (1) with an increase in pressure that is less than 1 Bar.

10 Claims, 3 Drawing Sheets

(56) References Cited

Figure 1:
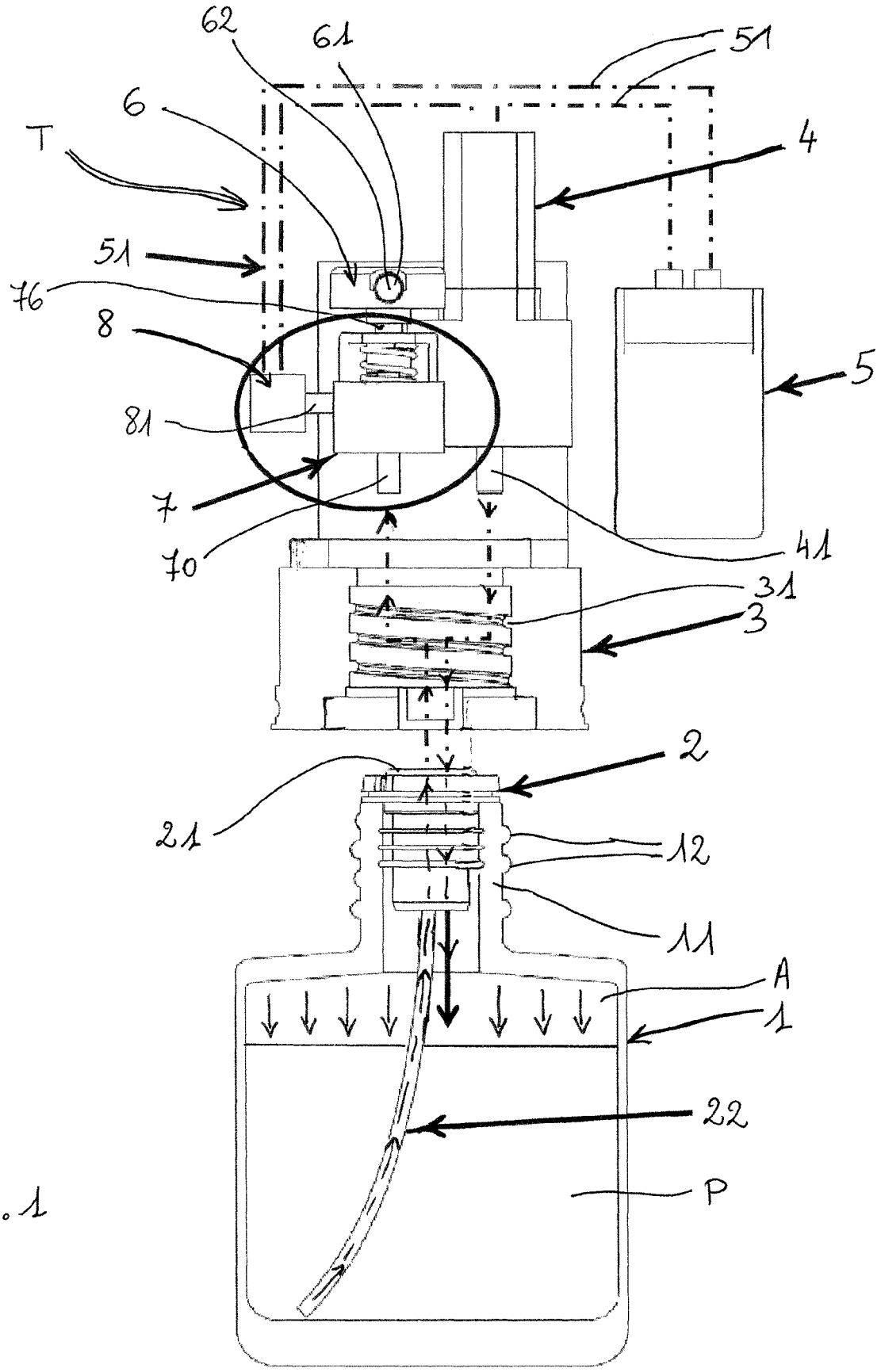

U.S. PATENT DOCUMENTS 2,613,995 A * 10/1952 Reinhold ..... B05B 1/304 222/468
3,993,250 A * 11/1976 Shure ..... B05B 9/0861 222/383.2
4,116,366 A * 9/1978 Takenakashima .. A47J 41/0033 222/131
4,222,525 A * 9/1980 Hildebrandt ..... B05B 7/2416 222/401
4,972,975 A * 11/1990 Fuhrig ..... B05B 7/0025 222/182
5,046,667 A * 9/1991 Fuhrig ..... B05B 7/2416 222/399
5,192,009 A * 3/1993 Hildebrandt ..... B05B 7/0433 222/400.5
5,716,007 A * 2/1998 Nottingham ..... B05B 9/0861 222/333
7,032,841 B1 * 4/2006 Swisher ..... B05B 9/0861 222/333
7,798,373 B1 * 9/2010 Wroblewski ..... B05B 11/00 222/1
7,975,881 B1 * 7/2011 Glucksman ..... B67D 1/0425 221/150 R
2005/0045745 A1 * 3/2005 Kutay ..... B05B 7/2416 239/419
2006/0091238 A1 * 5/2006 Kutay ..... B05B 7/2416 239/373
2006/0208005 A1 * 9/2006 Sweeton ..... B05B 9/0861 222/333
2007/0138318 A1 * 6/2007 Wanbaugh ..... B05B 9/0861 239/302
2007/0215724 A1 * 9/2007 Sweeton ..... B05B 7/2464 239/525
2008/0265060 A1 * 10/2008 Canfield ..... B05B 7/2416 239/373
2009/0032618 A1 * 2/2009 Hornsby ..... B05B 1/3436 239/333
2010/0006671 A1 1/2010 Seabase et al.
2012/0267396 A1 10/2012 Quinlan, Jr.
2013/0126560 A1 * 5/2013 Raffaghello ..... B05B 7/2416 222/394
2016/0192760 A1 * 7/2016 Nishiura ..... A45D 19/02 239/337
2017/0304854 A1 * 10/2017 Jacquemart ..... B05B 9/0811

OTHER PUBLICATIONS

Written Opinion for PCT/FR2015/053591 dated Apr. 4, 2016 [PCT/ISA/237].

International Preliminary Report on Patentability with the translation of Written Opinion dated Jun. 29, 2017, issued by the International Bureau in counterpart International Application No. PCT/FR2015/053591.

* cited by examiner

FLUID-PRODUCT DISPENSER

CROSS REFERENCE TO RELATED APPLICATIONS

This application is a National Stage of International Application No. PCT/FR2015/053591 filed Dec. 17, 2015, claiming priority based on French Patent Application No. 1462965 filed Dec. 19, 2014, the contents of all of which are incorporated herein by reference in their entirety.

The present invention relates to a fluid dispenser comprising: a reservoir containing air and a fluid; a dispenser head that is provided with a dispenser orifice for dispensing the fluid; and a dip tube that conveys the fluid from the reservoir to the dispenser head. The dispenser head comprises: an electric pump that delivers air into the reservoir so as to force fluid through the dip tube as far as the dispenser head; a battery unit; a pusher for activating the electric pump; and a fluid outlet valve that is arranged upstream from the dispenser orifice for selectively interrupting the feed to the dispenser head, the outlet valve being actuated by the pusher.

Advantageous fields of application of the present invention are the fields of perfumery, cosmetics, and pharmacy.

In the prior art, document EP 1 513 616 is known which describes a manual spray device comprising a reservoir and a nozzle for producing a spray. Furthermore, the spray device also comprises an electric pump for creating the force required to move liquid from the reservoir to the nozzle. In that document, the electric pump is a micro-electro-mechanical systems (MEMS) pump. In practice, the spray device includes a large number of MEMS pumps. In order to power the MEMS pumps, the spray device incorporates a battery unit, and in order to activate the MEMS pumps, the spray device includes a pusher. The spray device also comprises a dip tube that connects the reservoir to the nozzle by means of an outlet valve. MEMS pumps are also connected to the reservoir by means of an air inlet valve. The structure of the spray device is generally made as a single piece with the MEMS pumps arranged beside the reservoir, and the battery unit arranged below the pumps and the reservoir.

When the pusher of the spray device is pressed, a signal is sent to an electronic card that simultaneously powers the MEMS pumps, opens the air inlet valve, and opens the fluid outlet valve. Consequently, the pressure inside the reservoir is increased by air entering the reservoir, and the fluid leaves through the dip tube, the open outlet valve, and the nozzle. In response, the fluid is dispensed in spray form while the user continues to press on the pusher.

However, with that prior-art spray, a drawback exists during the beginning of the spraying stage. Specifically, spraying does not immediately reach steady conditions, such that some fluid is dispensed without being sprayed at the beginning of the dispensing stage. This results from the fact that the air delivered into the reservoir does not enable the pressure of the fluid stored in the reservoir to rise immediately. Specifically, since air is a compressible fluid, it tends to compress inside the reservoir before transmitting its thrust to the fluid.

An object of the invention is to remedy the drawback of the prior art by defining a fluid dispenser having an electric pump and an outlet valve, and in which the dispensing of fluid from the dispenser orifice does not involve a laborious initial dispensing stage. Another object of the present invention is to obtain fluid dispensing that is substantially steady over its entire duration, and in particular in its initial stage.

Another object of the present invention is to ensure that the dispensing of fluid from the dispenser orifice is independent of the rise in pressure of the fluid inside the reservoir.

To do this, the present invention proposes a fluid dispenser comprising:

- a reservoir containing air and a fluid;
- a dispenser head that is provided with a dispenser orifice for dispensing the fluid;
- a dip tube that conveys the fluid from the reservoir to the dispenser head;
- a pusher that is axially movable over a determined stroke;
- an electric pump that delivers air into the reservoir so as to force the fluid through the dip tube as far as the dispenser head, the electric pump being actuated by the pusher;
- a battery unit; and
- a fluid outlet valve that is arranged upstream from the dispenser orifice for selectively interrupting the feed to the dispenser head, the outlet valve being actuated by the pusher, the pusher occupying a high rest position that corresponds to a closed state of the outlet valve and a low depressed position that corresponds to an open state of the outlet valve;

the fluid dispenser being characterized in that:

- all of the air coming from the electric pump is delivered into the reservoir;
- the electric pump is activated by the pusher as soon as it leaves its high rest position, and the outlet valve is opened only in the proximity of the low depressed position, such that the electric pump is electrically powered well before the outlet valve is opened, thereby creating an increase in pressure in the reservoir before the outlet valve is opened; and
- the electric pump delivers air into the reservoir with an increase in pressure that is less than 1 Bar, and preferably about 450 millibars (mbar).

Thus, the fluid reaches the dispenser orifice at a certain pressure level, which avoids all of the above-mentioned drawbacks associated with bringing pressure on the fluid and dispensing from the dispenser orifice up to steady conditions. By way of example, the fluid outlet valve may be opened once the fluid stored inside the reservoir has reached a predetermined threshold, which may be the threshold of the electric pump. Thus, for an electric pump capable of generating an increase in pressure of about 450 mbar, the outlet valve is opened only when the fluid inside the reservoir has reached this value. Consequently, the fluid begins being dispensed from the dispenser orifice under conditions that are identical, or almost identical, to steady conditions.

The electric pump is powered as soon as the pusher is moved, whereas the outlet valve opens only when the pusher is fully depressed. The entire stroke of the pusher is thus used to space apart in time the powering of the pump and the opening of the outlet valve. A few hundredths or tenths of a second suffice to cause the pressure of the fluid inside the reservoir to rise, and thus to begin dispensing fluid at a rate close to steady conditions.

It should be observed that the increase in pressure generated by the electric pump is relatively or remarkably small, thereby making it possible to put the fluid stored in the reservoir under pressure very quickly. It is precisely this short duration for raising pressure that makes it possible to use an axially-movable pusher of stroke that determines the duration for raising pressure. A synergetic effect thus exists between the small increase in pressure created by the electric pump and the pusher being axially movable.

In a practical embodiment, the outlet valve is actuated mechanically by the pusher. This means that the actuation of the outlet valve does not need any electric power or processing.

In another practical aspect of the invention, the dispenser may include an electric switch for triggering the powering of the electric pump, the electric switch being actuated mechanically by the pusher. In a practical embodiment, the electric switch includes a movable stud that comes into engagement with a cam that is formed by a movable member of the outlet valve on which the pusher is mounted, the cam coming into engagement with the movable stud as soon as the pusher leaves its high rest position.

In a preferred embodiment, the dispenser orifice is formed by a nozzle that is designed to deliver the fluid as a spray.

In another more structural aspect of the present invention, the dispenser head incorporates the electric pump, the battery unit, the pusher, and the outlet valve. The dispenser may further include a support element mounted on the reservoir, advantageously forming a neck having a fastener profile for the support element, the dispenser head being mounted on the support element. The dispenser may thus be made up of two sub-assemblies, namely a first sub-assembly that is constituted by the reservoir, possibly provided with a dip tube, and a second sub-assembly that is constituted by the head that incorporates the electric pump, the battery unit, the pusher, and the outlet valve. The two sub-assemblies are connected to each other by the support element.

According to another advantageous characteristic of the invention, the reservoir includes an air inlet valve that is forced into its open state by the air delivered by the electric pump. The reservoir may include a check valve that is forced into its open state by a duct that is secured to the dispenser head.

The spirit of the invention is to offset powering the electric pump and opening the outlet valve over a period of time, so as to allow the pressure of the fluid stored in the reservoir to rise. The use of a conventional axially-movable pusher with a determined stroke makes it possible, in very simple and effective manner, to create the time offset between the electric pump and the outlet valve. In particular, this is facilitated by an electric pump that generates an increase in pressure that is small, being less than 1 bar, and that is preferably about 450 mbar. The three-stage structure of the dispenser not only enables assembly to be easy, but also makes it possible to obtain a configuration that is close to the configuration of a conventional dispenser in the fields of perfumery, cosmetics, and pharmacy.

The invention is described below in greater detail with reference to the accompanying drawings, which show an embodiment of the invention by way of non-limiting example.

Figure 2A:
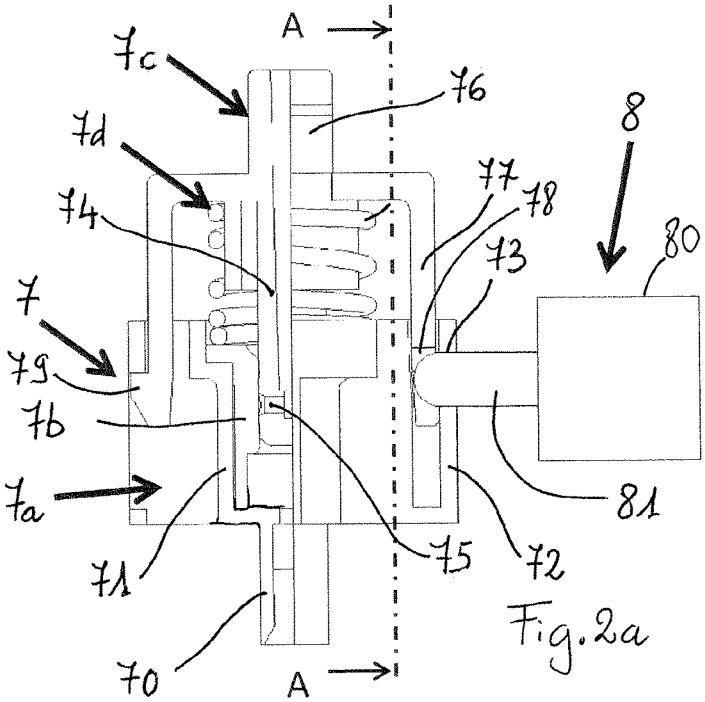
Figure 2B:
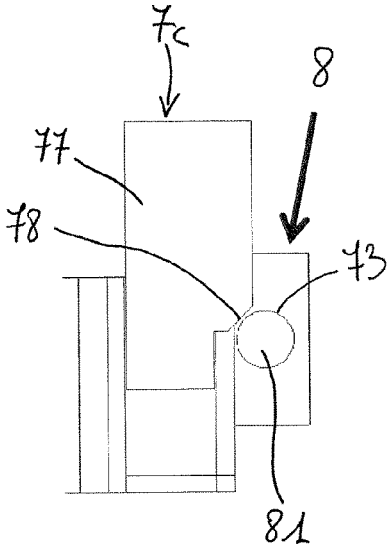

In the figures:

FIG. 1 is an exploded vertical section view of a fluid dispenser designed in accordance with the present invention;

FIG. 2*a* is a diagrammatic section view through the outlet valve of the FIG. 1 dispenser, in its initial rest position;

FIG. 2*b* is a diagrammatic section view on line AA of FIG. 2*a;*

Figure 3A:
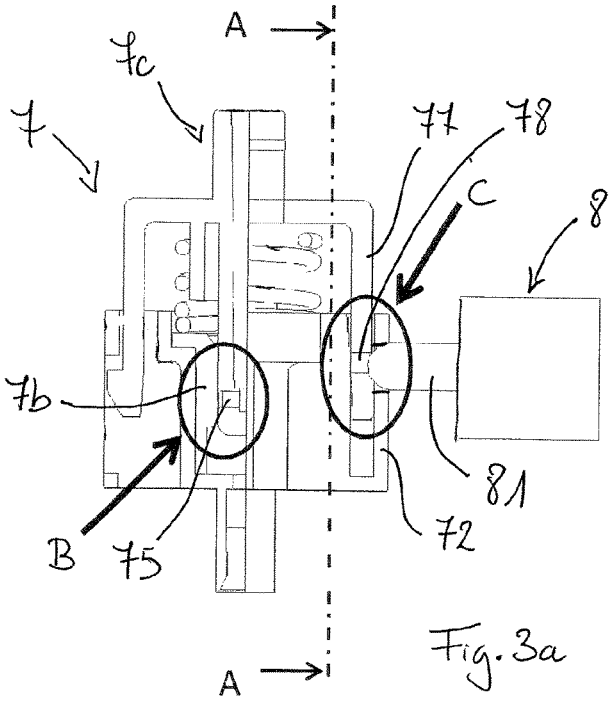
Figure 3B:
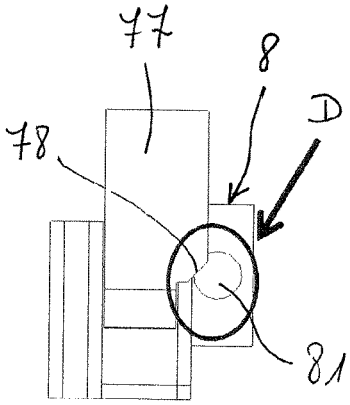
Figure 4A:
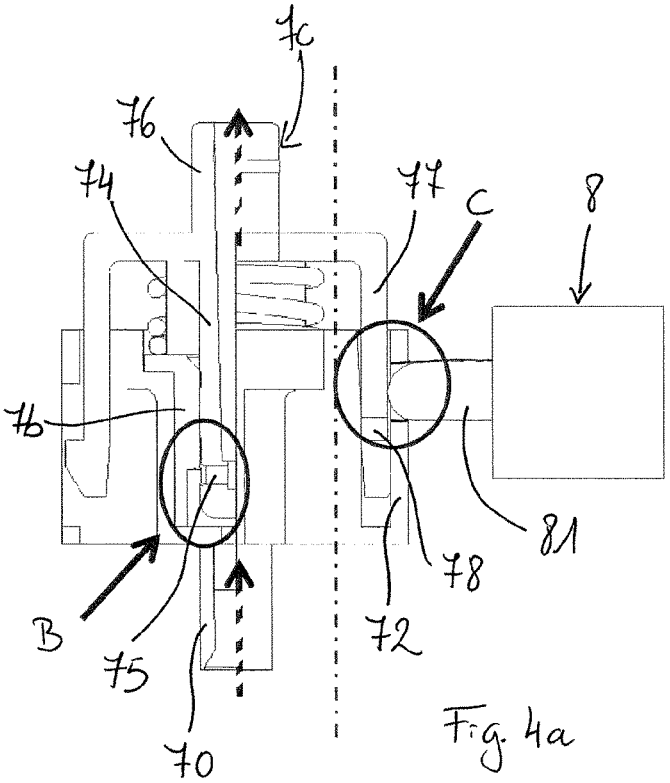
Figure 4B:
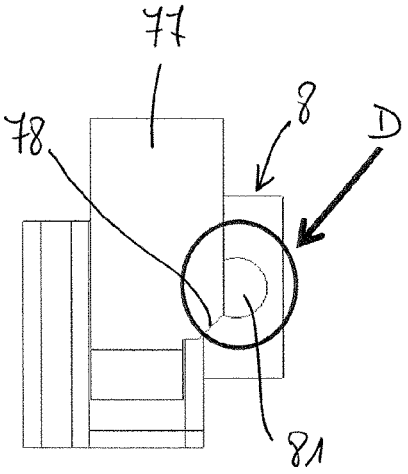

FIGS. 3*a* and 3*b* are views similar to the views in FIGS. 2*a* and 2*b* respectively, in the slightly depressed position; and FIGS. 4*a* and 4*b* are views similar to the views in FIGS. 2*a* and 2*b* respectively, in the fully depressed position;

Reference is made firstly to FIG. 1 in order to describe in detail the structure of the dispenser of the invention. Very generally, it comprises a fluid reservoir 1 on which a dispenser head T is mounted, preferably by means of a support element 3. It is advantageous for the reservoir 1 to serve as a base for the dispenser head T that is mounted thereon. This gives the dispenser an atomizer or spray device type configuration that is conventional in the fields of perfumery, cosmetics, and even pharmacy. The user holds the dispenser by the reservoir 1 and presses on the dispenser head T so as to actuate the dispenser.

The fluid reservoir 1 may be of any kind, of any shape, of any configuration, and it may be made of any appropriate material. In the embodiment used to illustrate the present invention, the reservoir 1 includes a neck 11 that defines an opening of section that is small compared to the reservoir body. The neck 11 may be provided with one or more fastener profiles 12 that form an outside thread in this embodiment. Alternatively, instead of the thread, it is possible to provide a snap-fastener or crimping profile. In FIG. 1, it can be seen that the reservoir 1 is filled mostly with a fluid P that is surmounted by a gap that is filled with air A.

The reservoir 1 may be provided with a stopper 2 that is inserted in leaktight manner into the neck 11. The stopper 2 serves as a support to a dip tube 22 that extends inside the reservoir 1 into the proximity of its bottom, or into contact therewith. The stopper 2 also includes a valve flap 21 that defines a check valve (not shown) that is forced into its open state by a duct 70 that is secured to the dispenser head T. In addition, the stopper 2 may also include an air inlet valve (not shown) that is forced into its open state by the air delivered by the electric pump 4, as described below. In other words, the valve flap 21 manages the incoming flow of air and the outgoing flow of fluid. The dip tube 22 is connected directly to the fluid check valve that is forced into its open state by the duct 70. It should be kept clearly in mind that the stopper 2 could be no more than a support for the dip tube 22. In a variant, the stopper 2 could also be omitted.

The support element 3 is an optional part that is fitted on the reservoir 1, and more precisely on the neck 11. To do this, the inside of the support element 3 defines a thread 31 that co-operates with the thread 12 of the neck 11. Naturally, the support element 3 is fastened on the neck 11 in leaktight manner.

The dispenser head T includes an electric pump 4 that is suitable for delivering air to the reservoir 1 so as to put it under pressure. The electric pump 4 includes an air outlet 41 that extends through the support element 3 and advantageously comes into contact with the air inlet valve as formed by the valve flap 21. As a result, the air delivered by the electric pump 4 presents sufficient pressure to open the check valve. The electric pump 4 advantageously includes a single motor that is suitable for generating an increase in air pressure that is less than 1 bar, and that is preferably about 450 mbar. In empirical manner, it should be observed that an increase in pressure of 200 mbar does not enable a spray of good quality to be produced. Conversely, an increase in pressure of 600 mbar would give results that are not very satisfactory. The range 350 mbar to 550 mbar is acceptable, with the value 450 mbar being preferred. In other words, the electric pump 4 generates a relatively or remarkably small increase in pressure. The air discharged by the electric pump 4 thus reaches the inside of the reservoir 1 so as to put the fluid under pressure.

In order to power the electric pump 4 electrically, a battery unit 5 is provided that forms an integral part of the dispenser head T. In FIG. 1, the battery unit is shown beside the electric pump 4 to simplify the figure, but in reality the battery unit 5 is arranged behind the electric pump 4 so as obtain a dispenser head that is compact.

The dispenser head T also includes a pusher 6 on which the user can press by means of one or more fingers so as to actuate the dispenser. The pusher 6 advantageously incorporates a nozzle 61 that forms a dispenser orifice 62 where the fluid is dispensed in the form of a spray.

The dispenser head T also includes a fluid outlet valve 7 having an inlet that includes the duct 70 for forcing the check valve into its open state. The valve 7 has an outlet covered by the pusher 6. Thus, by pressing on the pusher 6, the user causes the outlet valve 7 to open. The structure and the operation of the valve 7 are described more fully below.

The dispenser head T also includes an electric switch 8 that is a mechanical switch that makes it possible to close or loop an electric circuit. The electric switch 8 includes a movable stud 81 that is actuatable by the outlet valve 7. The battery unit 5 powers the electric pump 4 by means of the electric switch 8. In this particular embodiment, it should be observed that the battery unit 5 is dedicated to powering only the electric pump 4 and not the outlet valve 7. However, without going beyond the ambit of the invention, it could be envisaged to use the battery unit 5 to power both the pump 4 and the outlet valve 7.

As can be understood from FIG. 1, the dispenser head T, incorporating the battery unit 5, the electric pump 4, the pusher 6, the outlet valve 7, and the electric switch 8, is mounted on the reservoir 1 by means of the support element 3.

Reference is made below to FIGS. 2*a* to 4*b* in order to describe in detail the structure of the outlet valve 7 and its operation in relation to the electric switch 8.

In FIGS. 2*a* and 2*b*, the outlet valve 7 and the electric switch 8 are shown in the initial rest position. In other words, the outlet valve 7 is closed and the electric switch 8 is open. In FIG. 2*a*, it can be seen that the outlet valve 7 comprises a stationary body 7*a* that forms the duct 70, a cylinder 71, and an outer bushing 72 that is pierced by an opening 73. The inside of the cylinder 71 receives a liner 7*b*. The outlet valve 7 also comprises a movable member 7*c* forming a hollow rod 74 that is provided with a side orifice 75. At its opposite end, the hollow rod 74 forms a connection sleeve 76 on which the pusher 6 is mounted. The movable member 7*c* also includes an outer skirt 77 that is engaged inside the outer bushing 72. The skirt 77 forms a cam surface 78 in the proximity of the hole 73. The skirt 77 may also form one or more fastener teeth 79 that are in engagement with the outer bushing 72. The outlet valve 7 also comprises a return spring 7*d* that acts between the liner 7*b* and the movable member 7*d* so as to push the movable member into a rest position in which the teeth 79 are in engagement with the outer bushing 72, and the side orifice 75 is closed by the liner 7*b*. It should also be observed that the cam surface 78 in the rest position is situated in the top portion of the hole 73.

The electric switch 8 is not described in its entirety, since numerous models are commercially available. As a result, it is represented only by a square 80 from which there extends a movable stud 81 that serves as a pusher for the switch. The movable stud 81 is engaged to slide inside the hole 73, such that it extends inside the outer bushing 72 below the cam surface 78, as can be seen very clearly in FIG. 2*b*. More precisely, and by way of example, the movable stud 81 may be of cylindrical section and may present a rounded end that comes to be situated adjacent to the cam surface 78 that slopes. In the rest position in FIGS. 2*a* and 2*b*, the cam surface 78 is not in contact with the movable stud 81, or it bears lightly thereon without moving it. It should be understood that as soon as the movable member 7*c* moves downwards it causes the sloping cam surface 78 to come into engagement with the movable stud 81.

With reference to FIGS. 3*a* and 3*b*, the outlet valve 7 and the electric switch 8 can be seen in an intermediate position that is slightly actuated or depressed. Specifically, with reference to the circled details B, C, and D, it can be seen that the movable member 7*c* has moved over only a very short distance relative to its full stroke. The side hole 75 is still closed by the liner 7*b*, as can be seen in detail B, whereas the movable stud 81 is pressed in fully by the sloping cam surface 78, as can be seen in details C and D. Consequently, in this intermediate position, the outlet valve 7 is still closed, whereas the electric switch 8 is already actuated. This means that the electric pump 4 is electrically powered by the battery unit 5, and air under pressure is injected into the reservoir 1 so that the fluid P is put under pressure. However, fluid is not dispensed from the dispenser orifice 62, given that the outlet valve 7 is closed. The pressure thus rises in the fluid reservoir 1 until the outlet valve 7 opens.

With reference to FIGS. 4*a* and 4*b*, the movable member 7*c* is shown fully depressed over its entire stroke. In detail B, it can be seen that the side hole 75 is now arranged below the liner 7*b*, so that fluid from the reservoir can flow through the hollow rod 76 towards the pusher 6. In details C and D, it can be seen that the movable stud 81 is still pushed in fully, no longer by the cam surface 78, but directly by the skirt 77. In this low depressed position, the outlet valve 7 is open and the electric switch 8 is actuated. This means that the fluid stored in the reservoir 1 and put under pressure by the air injected by the electric pump 4 can flow through the dip tube 22 and the outlet valve 7 in its open state, until it reaches the dispenser orifice 61 where it is sprayed.

Thus, the axial stroke of the movable member 7*c* of the outlet valve 7 is used to space apart or offset over time the actuation of the electric switch 8 and the opening of the outlet valve 7. In the initial rest position, the electric switch 8 is off, and the outlet valve 7 is closed. However, as soon as the pusher 6 is pressed, the electric switch 8 is actuated immediately. This corresponds to the initial stage of the stroke of the movable member 7*c*. The electric switch 8 thus remains actuated throughout the duration of the stroke of the movable member 7*c* with the outlet valve closed. It is only in the proximity, or at the end, of the stroke of the movable member 7*c* that the outlet valve is opened, with the electric switch 8 still activated. The time offset between activing the electric switch 8 and opening the outlet valve 7 depends on the height of stroke of the movable member 7 and on the stiffness of the return spring 7*d*. However, the time offset can be evaluated as being about 5 hundredths of a second.

It should also be observed that the maximum increase in pressure inside the reservoir 1 is quickly reached given that the electric pump 4 generates only an increase in pressure that is less than 1 bar, and that is preferably about 450 mbar. As a result, the stroke of the movable member 7 is sufficient to generate the time offset that makes it possible to establish the maximum increase in pressure inside the reservoir. It should also be noted that the outlet valve 7 is only mechanical, and thus does not need any electrical power. The same applies to the electric switch 8; it is actuated mechanically, with its movable stud 8 being moved by the movable member 7*c* of the outlet valve 7. The battery unit is thus devoted completely to the electric pump 4 that is very low powered. However, without going beyond the ambit of the invention, it is possible to trigger the powering of the electric pump 4 with an electric contactor or an electronic time offset.

The invention thus provides a pneumatic electrical dispenser having dispensing quality that is steady over the entire duration of actuation. Furthermore, the dispenser can be configured like a dispenser that is conventional in the fields of cosmetics, perfumery, and pharmacy.

The invention claimed is:

1. A fluid dispenser comprising:

a reservoir containing air and a fluid;

a dispenser head that is provided with a dispenser orifice for dispensing the fluid;

a dip tube that conveys the fluid from the reservoir to the dispenser head;

a pusher that is axially movable over a determined stroke;

an electric pump that delivers air into the reservoir so as to force the fluid through the dip tube as far as the dispenser head, the electric pump being actuated by the pusher;

a battery unit; and a fluid outlet valve that is arranged upstream from the dispenser orifice for selectively interrupting a feed to the dispenser head, the outlet valve being actuated by the pusher, the pusher occupying a high rest position that corresponds to a closed state of the outlet valve and a low depressed position that corresponds to an open state of the outlet valve;

wherein:

all of the air coming from the electric pump is delivered into the reservoir;

the electric pump is activated by the pusher as soon as the pusher leaves the high rest position, and the outlet valve is opened only in proximity of the low depressed position, such that the electric pump is electrically powered well before the outlet valve is opened, thereby creating an increase in pressure in the reservoir before the outlet valve is opened; and the electric pump configured to deliver the air into the reservoir with an increase in the pressure that is less than 1 Bar.

2. A dispenser according to claim 1, wherein the electric pump is configured to deliver the air into the reservoir with an increase in the pressure of about 450 mbar.

3. A dispenser according to claim 1, wherein the dispenser head incorporates the electric pump, the battery unit, the pusher, and the outlet valve.

4. A dispenser according to claim 3, further including a support element mounted on the reservoir that forms a neck having a fastener profile for the support element, the dispenser head being mounted on the support element.

5. A dispenser according to claim 1, wherein the outlet valve is actuated mechanically by the pusher.

6. A dispenser according to claim 1, including an electric switch for triggering the powering of the electric pump, the electric switch being actuated mechanically by the pusher.

7. A dispenser according to claim 6, wherein the electric switch includes a movable stud that comes into engagement with a cam that is formed by a movable member of the outlet valve on which the pusher is mounted, the cam coming into engagement with the movable stud as soon as the pusher leaves the high rest position.

8. A dispenser according to claim 1, wherein the dispenser orifice is formed by a nozzle that is designed to deliver the fluid as a spray.

9. A dispenser according to claim 1, wherein the reservoir includes an air inlet valve that is forced into the open state by the air delivered by the electric pump.

10. A dispenser according to claim 1, wherein the reservoir includes a check valve that is forced into the open state by a duct that is secured to the dispenser head.

* * * * *